United States Patent [19]

Shumaker et al.

[11] 4,020,780

[45] May 3, 1977

[54] MOORING CABLE CUTTING SYSTEM

[75] Inventors: Richard K. Shumaker, Panama City; William G. Harris, Jr., Titusville, both of Fla.

[73] Assignee: The United States of America as represented by the Secretary of the Navy, Washington, D.C.

[22] Filed: Nov. 5, 1969

[21] Appl. No.: 870,550

[52] U.S. Cl. ..... 114/243; 114/221 A; 89/1 M

[51] Int. Cl.[2] ..... B63B 21/60; B63G 7/02; B63G 7/04

[58] Field of Search ..... 102/15; 114/235.2, 235, 114/221; 89/1.01

[56] References Cited

UNITED STATES PATENTS

| | | | |
|---|---|---|---|
| 2,395,892 | 3/1946 | Lontz | 114/235 X |
| 2,610,240 | 9/1952 | Pottorf | 114/235 X |
| 2,926,452 | 3/1960 | Lewis | 114/221 X |

*Primary Examiner*—Stephen C. Bentley
*Assistant Examiner*—Thomas H. Webb
*Attorney, Agent, or Firm*—Richard S. Sciascia; Don D. Doty; William T. Skeer

[57] ABSTRACT

An improved cable or chain cutting implement comprises a two piece body portion with sharpened cutting edges on one end thereof. The two pieces of the body portion are configured so as to encompass a towing or sweep cable in gripping relation thereto. A spring retaining member holds the pieces of the body portion in operative relationship to one another and the towing or sweep cable. A plurality of these cutting implements may be attached to a single towed sweep line to comprise an improved, high speed mine sweeping system.

10 Claims, 9 Drawing Figures

RICHARD K. SHUMAKER
WILLIAM G. HARRIS, JR.
INVENTOR.

BY William T. Skeen
Agent
Don A. Daily
Attorney

RICHARD K. SHUMAKER
WILLIAM G. HARRIS, JR.
INVENTOR.

BY William T. Skeen
Agent
Don D. Doty
Attorneys

RICHARD K. SHUMAKER
WILLIAM G. HARRIS, JR.
INVENTOR.

BY William T. Skeen
Agent
Don D. Dailey
Attorney

MOORING CABLE CUTTING SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATION

This invention is particularly suited for use as a cutter in the cutter system described in the pending application of William G. Harris, Jr. entitled "Mooring Line Cutter System," Ser. No, 775,995, filed on Nov. 8, 1968, and assigned to the assignee of this application.

BACKGROUND OF THE INVENTION

The present invention relates generally to cable cutters and, in particular, but not by the way of limitation, is a device for cutting marine mooring lines, cables, wires, and the like. More particularly, the present invention relates to an improved cutter for such moorings when used in securing marine mines and obstructor devices similarly moored in operative position.

Cutters used for this purpose may be roughly classified as either the active or passive types. the active types are triggered by contact with the mooring line, cable, or chain and activate a spring loaded blade or an explosive driven blade to cut the mooring. On the other hand, the passive type cutter severs the mooring line, cable, or chain by impacting a beveled cutting edge therewith, as the cutter is towed through the water.

The typical prior art towed cutters, both the active and passive types, require a hydrodynamic surface to position the blade at an optimum cutting attitude. The presence of these surfaces produces a drag which slows the towing vehicle for a given power output. Further, the individual cutters with these surfaces are relatively large and must be installed or removed when streaming or recovering the sweep from the water.

It is also known that the effectiveness of the sweep is increased as a result of an increased towing velocity. This is especially true when the mine field includes a relatively high percentage of obstructor devices. Aircraft, especially the modern rotary wing type, are ideally suited for this purpose. However, in the past, they have had their utility impaired by the difficulty in streaming and recovering the cumbersome prior art devices.

SUMMARY OF THE INVENTION

The device of the invention is of the passive type and, accordingly, shares with other cutters of that type the particular advantages inherent in that type of operation; that is, the mechanical complexity and other associated disadvantages of the active type are avoided. Certain of the prior art active type cutters have explosive activators which create storage problems which are also avoided with the construction of the invention.

The cutters of the present invention do not employ auxiliary hydrodynamic surfaces and are of such low drag that conventional aircraft, especially those of the rotary wing type, may be used as draft vehicles in conducting the high speed sweeping operation of marine mines. The size of the cutters makes it practical to stream and recover the sweep apparatus without removal of the cutter from the sweep lines.

The use of air craft as tractor vehicles, as facilitated by this invention, constitutes a profound improvement over the use of surface vessels for the sweeping of marine mines. The aircraft is a particularly maneuverable vehicle and is able to enter an enemy controlled mined area, conduct a minesweeping operation, and move to a safe area at the conclusion of the sweeping operation with a minimum exposure of personnel to enemy fire power and with a minimum expenditure of time. In such an aircraft based sweeping system, the chances of detection of the presence of the minesweeping activity by enemy personnel is small in comparison to the same operation conducted by surface vessels. Further, the aircraft deployed in the field requires less monetary and time expenditures for the logistic support thereof than a surface vessel.

The system of the present invention employs a moored cutter construction incorporating an improved method and means of fastening the individual improved cutters to the towed sweep line. These improvements, as noted above, facilitate the use of the system in connection with aircraft draft vehicles. Further, the improved cutter construction and the method of fastening which is made possible thereby permit sweep lines to be readily constructed and repaired in the field with a minimum of skilled personnel and a small expenditure of time. The results in this area alone constitute an advance in the mine sweeping arts of an unexpected nature such as to ensure a considerable monetary saving to the users of the invention. These improvements over the prior art are profound and transcend those results attributable to prior art devices and methods used in the known manner or modified by the use of ordinary mechanical skill.

This invention, therefore, has as an object thereof the provision of an improved cable cutting system and method.

A further object of this invention is to provide an improved cable cutting system and method for cutting the mooring lines, cables or chains of moored marine mines.

Another object of this invention is the provision of an improved cutting system and method for the severing of the mooring tether of any moored submerged buoyant object.

A further object of the present invention is the provision of an improved cutting system which may easily be assembled and disassembled for operation or maintenance aboard a towing vehicle with a minimum of manpower.

Another object of the present invention is the provision of a cable cutter system which may economically be manufactured stored and used.

A further object of the invention is to provide an improved cutting system to be used beneath the surface of a body of water for cutting submerged mooring cables when towed by an aircraft flying above said body of water.

Another object of this invention is to provide an improved cutter which may be readily attached to a flexible tow line with a minimum expenditure of time and without the use of special tools.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
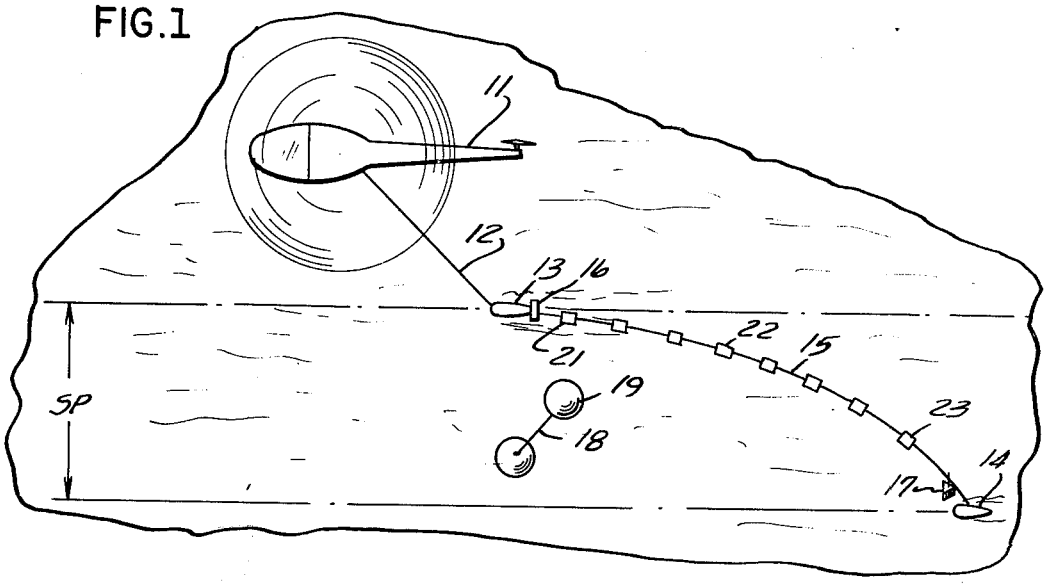
FIG. 1 is a plan view of the system of the invention in operational deployment.
Figure 2:
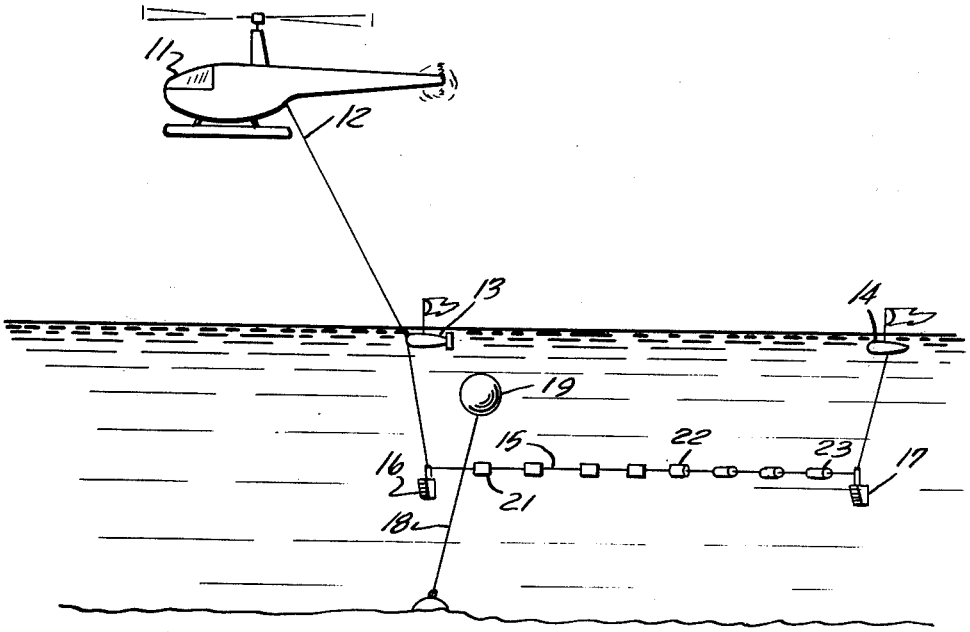
FIG. 2 is a side elevation of the system of the invention in operational deployment.

Referring to FIGS. 1 and 2, a rotary wing aircraft 11 is shown conducting a mine sweeping operation using the device of the invention. The sweep system is shown as being deployed as a diverted sweep sweeping a path indicated in FIG. 1 by the space SP between the broken lines. For this purpose, a tow line 12 connects aircraft 11 to the sweep system. Floats 13 and 14, component parts of the sweep system, mark the extremities of the sweep line 15 deployed therebetween. Sweep line 15 is held at an appropriate operational depth by a depressor 16 and an otter-depressor 17. As will be readily appreciated by those conversant with mine sweeping and other marine towing arts, otter-depressor 17 also deploys the distal end of sweep line 15 in a laterally displaced course from the bitter end thereof. The depressor 16 and otter-depressor 17 are attached, in a well known and conventional manner, so as to effect an optimum depth of deployment of sweep line 15 so as to sever mooring line 18 of a marine mine 19. Individual cutters 21, 22, and 23 are carried by sweep line 15 and are effective, in a manner to be described, to sever mooring line 18.

The spacing between individual cutters is approximately five feet. This interval has proven satisfactory in most instances but, as will be readily understood, the spacing can be adjusted to meet particular operational conditions.

The above description of the overall system and the accompanying illustrative figures should be understood to be an exemplary showing. Those persons familiar with the minesweeping arts will recognize that modifications to the described system may be made using known equivalent structures. For example, rotary wing aircraft 11 might be replaced with a fixed wing aircraft, air cushion vehicle, watercraft, or other draft vehicle. Similarly, other float and depressor and diverter arrangements than described above might be used to deploy sweep wire 15. Such modifications of applicant's system to optimize the operation thereof to meet certain operational conditions, as are obvious to the proficient marine engineer, are considered to be within the scope of the herein described invention.

The individual cutters 21, 22, and 23 are the heart of the cutting system of the invention. For purpose of explanation, FIGS. 1 and 2 show the three types of cutters in simultaneous use on a single sweep line 15. In actual application, the sweep line usually mounts but a single type of cutter. The choice of the particular type used will be dependent on the circumstances of operation, the personal preference of operational personnel, as well as certain other considerations.

Figure 3:
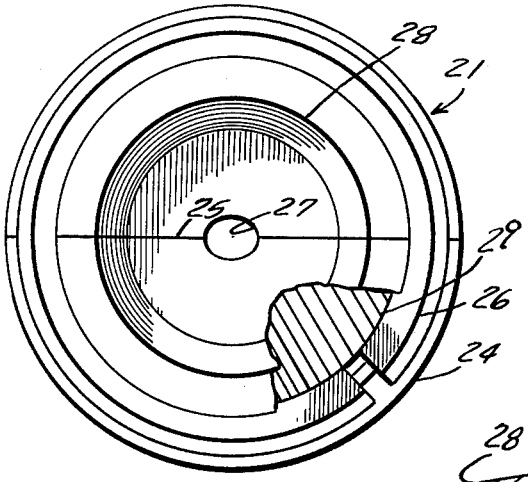
FIGS. 3 and 4 are end and side elevations, respectively, of a preferred embodiment of a cutter according to the invention.
Figure 4:
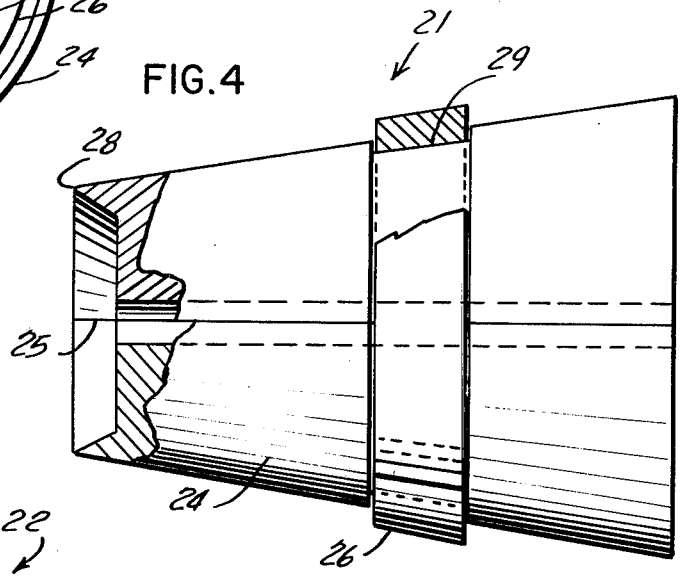

Referring to FIGS. 3 and 4, it is seen that cutter 21 comprises a conically tapered body portion 24. Body portion 24 is longitudinally divided into two halves by a common interface 25. The two halves are secured together into a unitary assembly by a spring retainer 26. The contraction force of spring retainer 26 causes body portion 24 to grip sweep line 15 in a centeral aperture 27 which is of eliptical cross section and extends longitudinally therethrough. Aperture 27 may have its inner surface roughened or otherwise figured to improve the frictional engagement with sweep line 15, if desired. The cutter may also be used in conjunction with other stop means carried on sweep line 15 to stop rearward movement of the cutter.

The foreward portion of cutter 21 is shaped to provide a sharpened edge 28. The impact of edge 28 on mooring line 18 causes it to be severed or weakened, depending upon the thickness thereof. In instances where the mooring line 18 is of too large a diameter to be completely severed by a single tool impact, the removal of material by the initial cutter impact creates a groove which guides sweep line 15 therealong such that the mooring line is impacted in the same region by additional cutters until the mooring is eventually severed.

Spring retainer 26 fits within a groove 29, thereby clamping the halves of body portion 24 tightly together. The halves of body portion are prevented relative rotational movement with respect to each other by the presence of the sweep line, not shown in FIGS. 3 and 4, which extends through aperture 27. Another check against the relative movement of the halves of body portion 24 is the torsional rigidity of spring retainer 26. It will be readily understood that interface 25 may be figured with interfitting grooves, if additional resistance to this rotational movement or other displacement of body portion 24 segments is desired. If interface 25 is to be figured, it will be an advantage if the grooves and lands are made in such a fashion that the two portions of body portion 24 are alike, thereby eliminating the necessity of manufacturing and storing separate constructions for the two halves.

Figure 5:
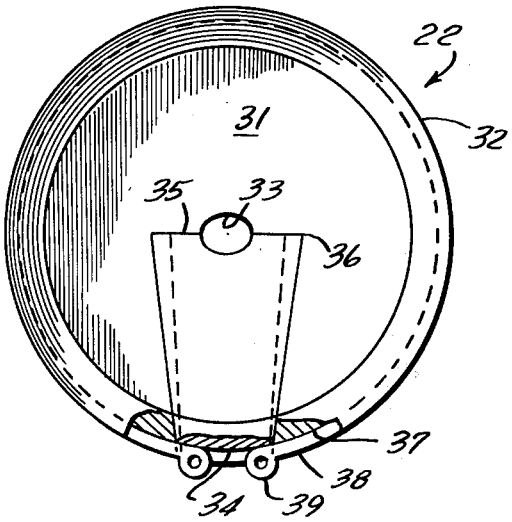
FIG. 5 is an end elevation of another preferred embodiment of a cutter according to the invention.
Figure 6:
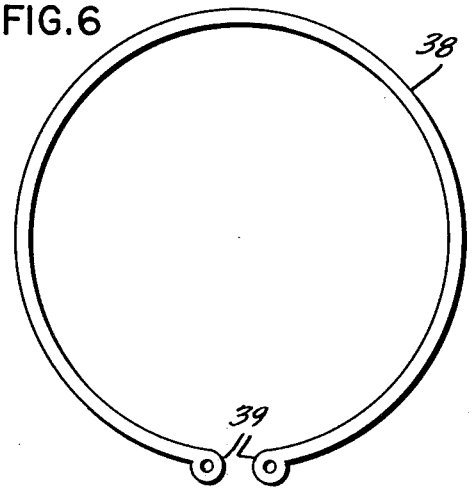
FIG. 6 is a view of a clamp member used in cutter units according to the invention.
Figure 7:
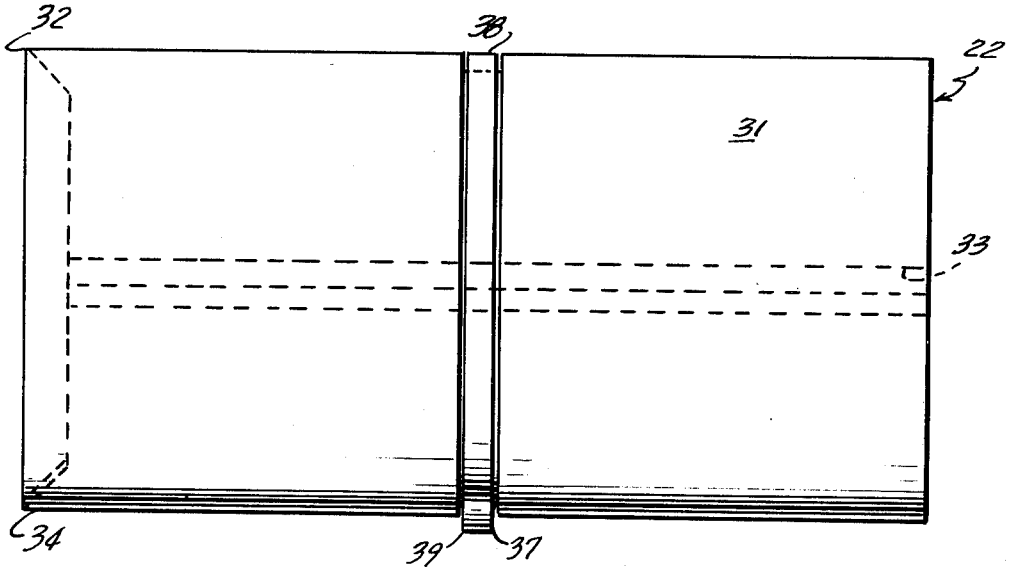
FIG. 7 is a side elevation of the cutter shown in FIG. 5.

Referring now to FIGS. 5, 6, and 7, another construction of the cutter of the invention is shown. Cutter 22 comprises a cylindrical body portion 31 having its forward end fashioned into a sharpened cutting edge 32. An eliptically cross sectioned longitudinally extending axial bore 33 extends through body portion 31 and a removable longitudinal segmental plug 34.

Plug 34 communicates from the outer surface of the body portion 31 to the center region thereof. The innermost face 35 of plug 34 is a plane containing the major diameter of bore 33. Plug 34 may be tapered along its length to positively index its longitudinally inserted position. The side or lateral surfaces 36 of plug 34 may also be tapered so as to cooperate with mating surfaces on body portion of close bore 33 on a sweep line extending therethrough. This double taper is best illustrated at FIG. 5.

A circumferential groove 37 extends about body portion 31 and plug 34 in the centeral region thereof. A spring retainer 38 fitted within groove 37 positions plug 34 and prevents accidental dislodgement thereof. Since plug 34 and body portion 31 are interfitting constructions, spring retainer 38 may be less strongly constructed than spring retainer 26, used with cutter 21. A major advantage of this construction is that the cutter may be more securely affixed to a sweep wire with only the use of hand tools. For this purpose, retainer 38 is provided with tool engaging loops 39.

Figure 9:
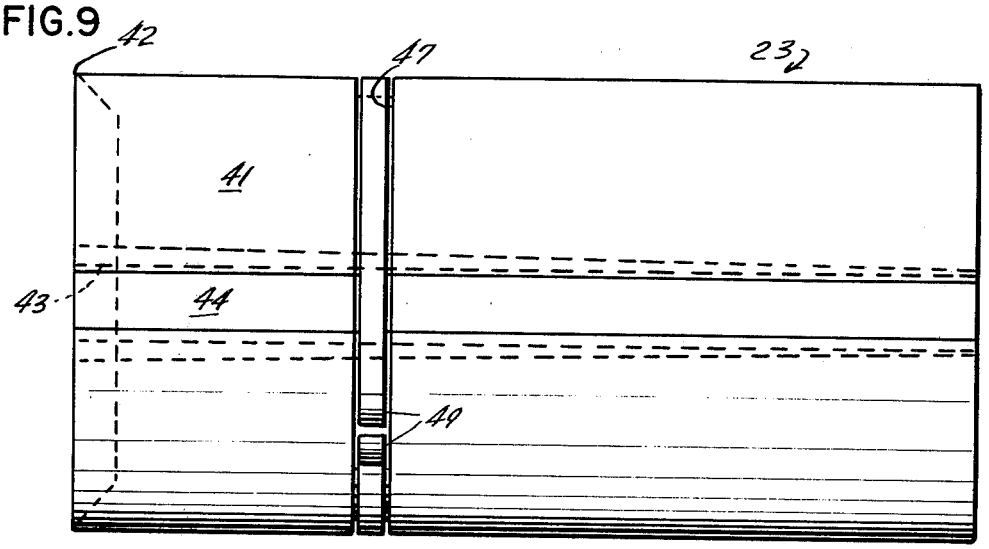
FIGS. 8 and 9 are end and side elevations, respectively, of a third embodiment of a cutter according to the invention.
Figure 8:
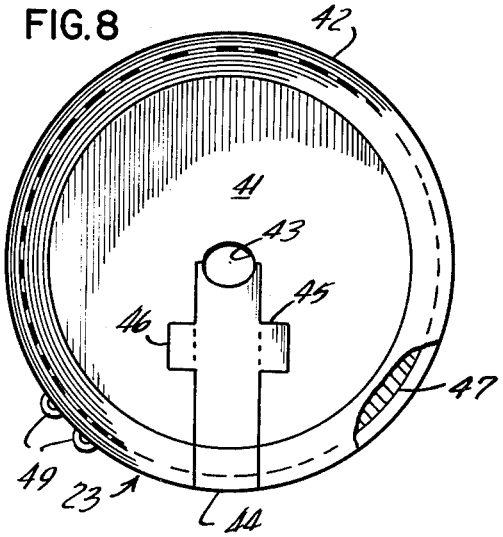

Referring now to FIGS. 8 and 9, the construction of cutter 23 is shown. Like cutter 22, cutter 23 has a cylindrical body portion 41 with a foreward facing sharpened cutting edge 42. An eliptical bore 43 penetrates the cutter longitudinally on the centeral axis thereof and is of such dimensions as to grip a sweep line passing therethrough. A segmental plug 44 extends longitudinally through the body portion 41 and communicates from the outer surface thereof to the eliptical bore 43 so as to permit, when plug 44 is removed, the body portion 41 to be placed on a sweep line.

As shown, plug 44 is of a Roman cruciform cross section. The horizontal surfaces 45 of the short arm portion provide indexing surfaces which interfit with mating surfaces in body portion to effectively position plug 44 with relation to bore 43 and the sweep wire, when secured therein. The lateral surfaces 46 are longitudinally tapered so as to positively index plug 44 within body portion 41, such that the portion of the sharpened cutting edge 42 carried thereby is continuous with that portion on the foreward portion of body portion 41. A cicumferentially encompassing groove 47 extends about the cylindrical body portion 41 and plug 44 and together with a spring retainer 48, having tool engaging loops 49, positions plug 44 against accidental removal. Spring retainer 48 is substantially identical to spring retainer 38, and, accordingly, is not separately illustrated.

Although the preferred embodiments disclosed herein are shown as having forward cutting edges of a circular knife-like configuration, it should be understood that any suitable cutting edge may be substitued therefore which facilitates the operation of the cutter during any given circumstances. For example, said cutter could include saw-teeth, square teeth, or the like, of any desired number or configuration. Obviously, it would be well within the purview of one skilled in the art having the benefit of the teachings herein presented to make the proper cutting edge selection, inasmuch as so doing would only involve the making of design choices.

Similarly, some freedom of choice is permitted the skilled artisan in the placement of the groove and spring retainer. That is, it is not essential that the groove be in the longitudinal center of the cutter as is groove 37, shown in FIG. 7, but may it be forward the foreward end, as shown in the placement of groove 47, shown in FIG. 8. Further, the body portions 31 and 41 together with fitted plugs 34 and 44 may be of a frustroconical shape, like body portion 24, rather than cylindrical, if desired. Likewise, some freedom of choice in materials used in the construction of the cutter is possible. It is obvious that the material should possess sufficient hardness to cut the particular material desired. For wire rope and chains used in mooring marine mines, a satisfactory hardness range of Rockwell C-56 to C-58 has been obtained by performing conventional heat treatment procedures on units fashioned of conventional drill rod stock. Similarly, cutting edges may be placed on either end of the cutter body or both ends, if desired. Such modifications are considered to be within the scope of engineering personnel familiar with mine sweeping methods and apparatus.

PREFERRED MODE OF OPERATION

In order to insure the maximum benefits and advantages from the aforedescribed invention, the preferred mode of operation and manner of utilization, as will now be described, should be followed. Those who are versed in the mine sweeping arts will be able to utilize this mode of operation together with the foregoing description of the preferred embodiment to practice the invention. Some circumstances may require slight modifications in order to practice the invention in an optimum manner for the particular operational environment, but such changes are normally performed by such proficient artisans.

A suitable length of sweep line of the desired type is placed in position to permit the attachment of cutters thereto. Any of the types of cutters described herein as cutters 21, 22, and 23 may be used. The sweep line may be of any suitable type. For purposes of completeness, it should be noted that six hundred foot lengths of one-quarter inch diameter seven by nineteen strand steel wire rope has proven effective for the desired purpose.

The individual cutters are attached by first placing the two major body components, halves of body portion 24, or body portions 31 or 41 and plugs 34 or 44, in position to grip the sweep line in the centeral bore therein. Secondly, a spring retainer is placed in the groove provided in the body parts to be held together thereby. In the case of cutter 21, special hydraulic or other press means may be used to install spring retainer 26. This process is repeated at suitable intervals, for example five to ten feet, along the length of the sweep lines.

The sweep line is then attached to suitable streaming gear such as depressor 16 and otter-depressor 17 and towed at a suitable depth through the mine field. The precise depth at which the wire is towed beneath the surface is determined by the type vessel for which a sweep is being provided and the type mine encountered and is therefor subject to considerable variation.

As the sweep wire encounters various mooring lines, it is drug thereacross by the foreward motion of the aircraft tow vehicle. The individual cutters impact the mooring lines and the sharpened edges thereof strike the mooring line to cause the severing thereof. The mine or obstructor thus freed from its mooring floats to the surface where it may be destroyed or removed.

The foregoing description taken together with the appended claims constitute a disclosure such as to enable a person skilled in the mine sweeping and naval engineering arts and having the benefit of the teaching contained therein to make and use the invention. Further, the structure herein described meets the objects of invention, and generally constitutes a meritorious advance in the art unobvious to such a skilled worker not having the benefit of the teachings contained herein.

What is claimed is:

1. A mine sweeping system for severing mooring cables or lines of moored marine mines located within a predetermined aqueous medium comprising in combination:

tractor vehicle means;

tow line means attached at one end to said tractor vehicle means for transmission of towing force therefrom;

sweep line means effectively attached to said tow line means to be towed thereby;

hydrodynamic means effectively attached to said sweep line means for deploying said sweep line means at a predetermined relative position with respect to said aqueous medium and the course of said tractor vehicle means, so as to perform a sweep over a predetermined path width;

cutter means connected to said sweep line means effective to impact said mooring cables or lines for the severing thereof wherein said cutter means comprises:

body means comprised of two structural parts mutually cooperating to form a unitary structure which is a figure of revolution about a centeral axis thereof;

sharpened edge means carried by said body means to face in a foreward direction along said axis of revolution;

a longitudinal bore extending along said axis of revolution and passing through the length of said body means and having a portion thereof extending into each of said structural parts for the passage of said sweep line means therethrough;

groove means extending circumferentially about said body means and extending a predetermined distance therein; and spring retainer means positioned within said groove means and effective to hold said two structural parts of said body means together about said sweep line means for retention thereof therein, so as to structurally connect said cutter means to said sweep line means.

2. A mine sweeping system according to claim 1 in which said tractor vehicle is a rotary wing aircraft.

3. A mine sweeping system according to claim 1 in which said figure of revolution of said body means is a cylinder.

4. A mine sweeping system according to claim 1 in which said figure of revolution is a right conic frustrum

5. A mine sweeping system according to claim 1 in which said cutter means is made of an alloy of steel with a hardness of approximately Rockwell C-56.

6. A mine sweeping system according to claim 1 in which one of within said two structural parts of said body means is a longitudinal segmental plug removably inserted said other part thereof to facilitate the connection of said body means on said sweep line means.

7. A mine sweeping system according to claim 1 in which one of said two structural parts of said body means is a longitudinal segmental plug removably inserted within said remaining part thereof and having at least one longitudinally tapered surface thereon for longitudinally positioning said plug with respect to said remaining part thereof, and to facilitate the connection of said body means to said sweep line means.

8. A mine sweeping system according to claim 1 in which one of said two structural parts of said body means is a longitudinal segmental plug removably inserted within said remaining part thereof and having a cruciform cross section for radially positioning said plug with respect to said remaining part thereof, and to facilitate the connection of said body means to said sweep line means.

9. A mine sweeping system according to claim 1 in which said longitudinal bore is of eliptical cross section.

10. A mine sweeping system according to claim 1 in which said spring retainer means has tool engaging loops thereon.

* * * * *